US006405984B1

(12) United States Patent
Simons et al.

(10) Patent No.: US 6,405,984 B1
(45) Date of Patent: Jun. 18, 2002

(54) PEG RETAINING DEVICE

(76) Inventors: Darren W. Simons; Tamra K. Simons, both of 270 S 200 West P.O. Box 103, Fillmore, UT (US) 84631

( * ) Notice: Subject to any disclaimer, the term of this patent is extended or adjusted under 35 U.S.C. 154(b) by 0 days.

(21) Appl. No.: 09/658,410

(22) Filed: Sep. 8, 2000

(51) Int. Cl.[7] ..... A47B 96/06

(52) U.S. Cl. ..... 248/220.41; 248/221.11; 211/70.6

(58) Field of Search ..... 248/220.41, 220.42, 248/221.11, 220.31, 224.8; 211/70.6

(56) References Cited

U.S. PATENT DOCUMENTS 4,026,508 A * 5/1977 Ziegler ..... 248/223
4,512,481 A * 4/1985 Thalenfeld ..... 211/57.1
5,906,350 A * 5/1999 Kao ..... 248/688
5,996,817 A * 12/1999 Kao ..... 211/70.6
6,059,124 A * 5/2000 Weck et al. ..... 211/57.1
6,189,847 B1 * 2/2001 Hart ..... 248/220.31
6,193,200 B1 * 2/2001 Kao ..... 248/309.1
6,241,208 B1 * 6/2001 Lin ..... 248/309.1

* cited by examiner

*Primary Examiner*—Leslie A. Braun
*Assistant Examiner*—A. Joseph Wujciak

(57) ABSTRACT

A peg retaining device for preventing the pegs from falling out of the holes in the pegboard. The peg retaining device includes a retainer having a generally planar back side and also having a top, a bottom, and a front side, and being adapted to mount over a portion of at least one peg on a pegboard for securely retaining the at least one peg to the pegboard; and also includes fastening members being disposed through the retainer and being adapted to securely and removably engage in holes of the pegboard.

9 Claims, 3 Drawing Sheets

PEG RETAINING DEVICE

BACKGROUND OF THE INVENTION

1. Field of the Invention

The present invention relates to a peg holding member for a pegboard and more particularly pertains to a new peg retaining. device for preventing the pegs from falling out of the holes in the pegboard.

2. Description of the Prior Art

The use of a peg holding member for a pegboard is known in the prior art. More specifically, a peg holding member for a pegboard heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,112,014; U.S. Pat. No. 4,645,154; U.S. Pat. No. 4,714,221; U.S. Pat. No. 4,441,680; U.S. Pat. No. 4,304,382; and U.S. Pat. No. Des. 280,596.

While these devices fulfill their respective, particular objectives and requirements, the aforementioned patents do not disclose a new peg retaining device. The inventive device includes a retainer having a generally planar back side and also having a top, a bottom, and a front side, and being adapted to mount over a portion of at least one peg on a-pegboard for securely retaining the at least one peg to the pegboard; and also includes fastening members being disposed through the retainer and being adapted to securely and removably engage in holes of the pegboard.

In these respects, the peg retaining device according to the present invention substantially departs from the conventional concepts and designs of the prior art, and in so doing provides an apparatus primarily developed for the purpose of preventing the pegs from falling out of the holes in the pegboard.

SUMMARY OF THE INVENTION

In view of the foregoing disadvantages inherent in the known types of peg holding member for a pegboard now present in the prior art, the present invention provides a new peg retaining device construction wherein the same can be utilized for preventing the pegs from falling out of the holes in the pegboard.

The general purpose of the present invention, which will be. described subsequently in greater detail, is to provide a new peg retaining device which has many of the advantages of the peg holding member for a pegboard mentioned heretofore and many novel features that result in a new peg retaining device which is not anticipated, rendered obvious, suggested, or even implied by any of the prior art peg holding member for a pegboard, either alone or in any combination thereof.

To attain this, the present invention generally comprises a retainer having a generally planar back side and also having a top, a bottom, and a front side, and being adapted to mount over a portion of at least one peg on a pegboard for securely retaining the at least one peg to the pegboard; and also includes fastening members being disposed through the retainer and being adapted to securely and removably engage in holes of the pegboard.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new peg retaining device which has many of the advantages of the peg holding member for a pegboard mentioned heretofore and many novel features that result in a new peg retaining device which is not anticipated, rendered obvious, suggested, or even implied by any of the prior art peg holding member for a pegboard, either alone or in any combination thereof.

It is another object of the present invention to provide a new peg retaining device which may be easily and efficiently manufactured and marketed.

It is a further object of the present invention to provide a new peg retaining device which is of a durable and reliable construction.

An even further object of the present invention is to provide a new peg retaining device which is susceptible of a low cost of manufacture with regard to both materials and labor, and which accordingly is then susceptible of low prices of sale to the consuming public, thereby making such peg retaining device economically available to the buying public.

Still yet another object of the present invention is to provide a new peg retaining device which provides in the apparatuses and methods of the prior art some of the advantages thereof, while simultaneously overcoming some of the disadvantages normally associated therewith.

Still another object of the present invention is to provide a new peg retaining device for preventing the pegs from falling out of the holes in the pegboard.

Yet another object of the present invention is to provide a new peg retaining device which includes a retainer having a generally planar back side and also having a top, a bottom, and a front side, and being adapted to mount over a portion of at least one peg on a pegboard for securely retaining the at least one peg to the pegboard; and also includes fastening members being disposed through the retainer and being adapted to securely and removably engage in holes of the pegboard.

Still yet another object of the present invention is to provide a new peg retaining device that effectively keeps the hooks from falling out of the holes of the pegboard.

Even still another object of the present invention is, to provide a new peg retaining device that is easy and convenient to use by homeowners and retail store merchants.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
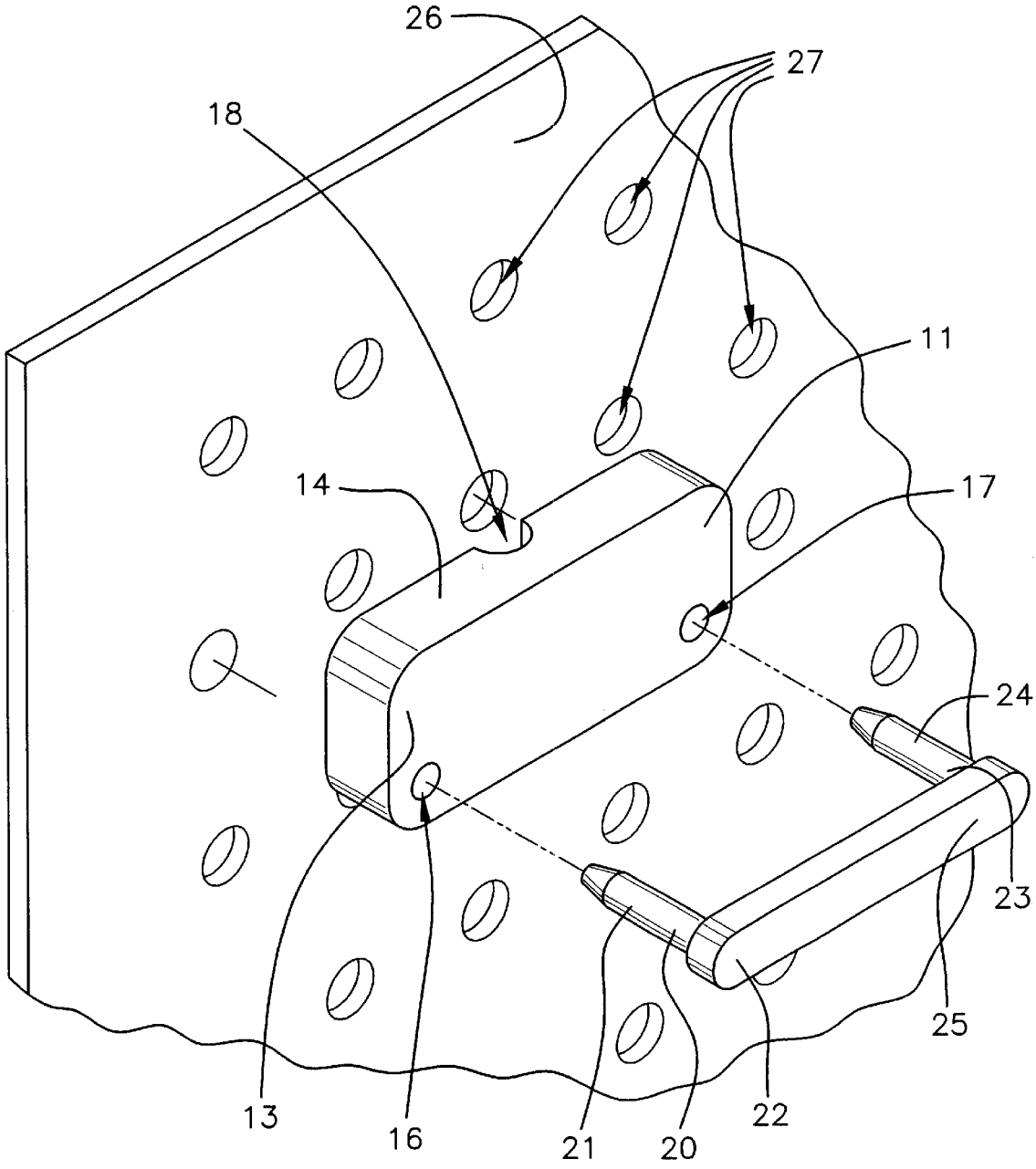
FIG. 1 is a front perspective view of a new peg retaining device according to the present invention.
Figure 2:
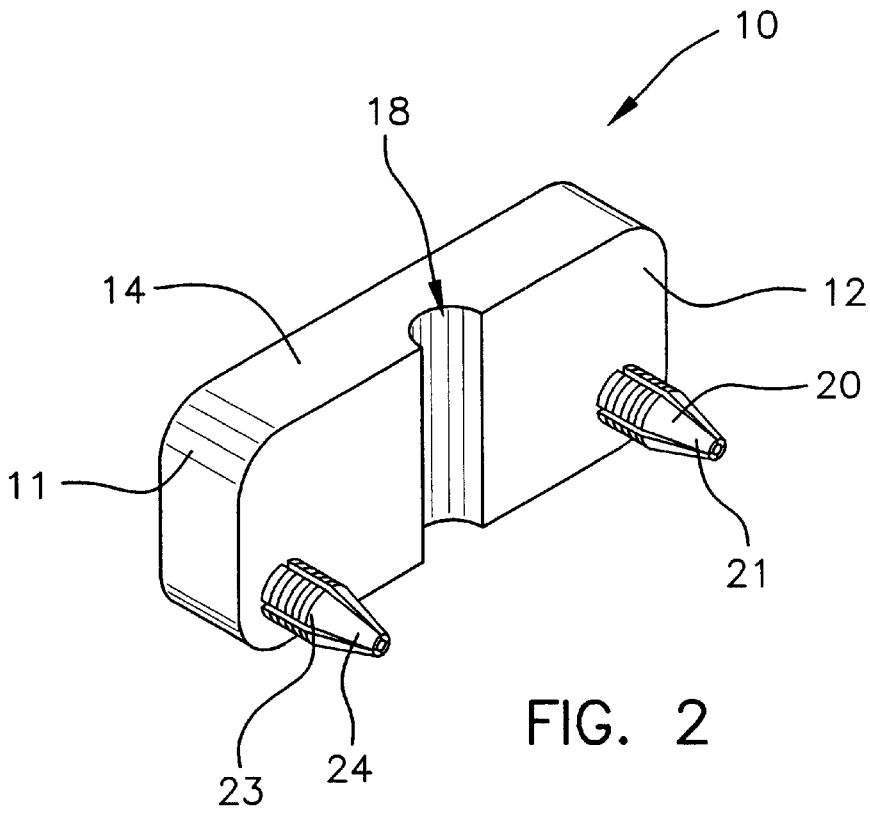
FIG. 2 is a rear perspective view of the present invention.
Figure 3:
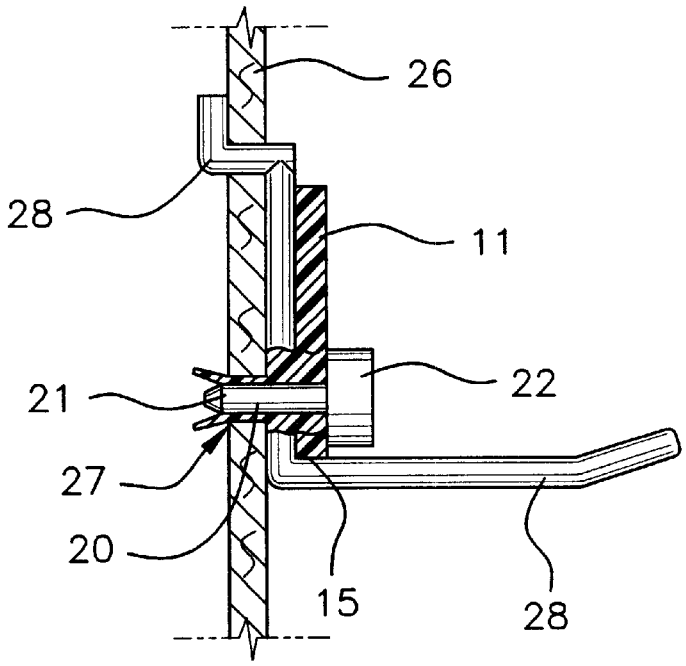
FIG. 3 is a side elevational view of the present invention shown in use.
Figure 4:
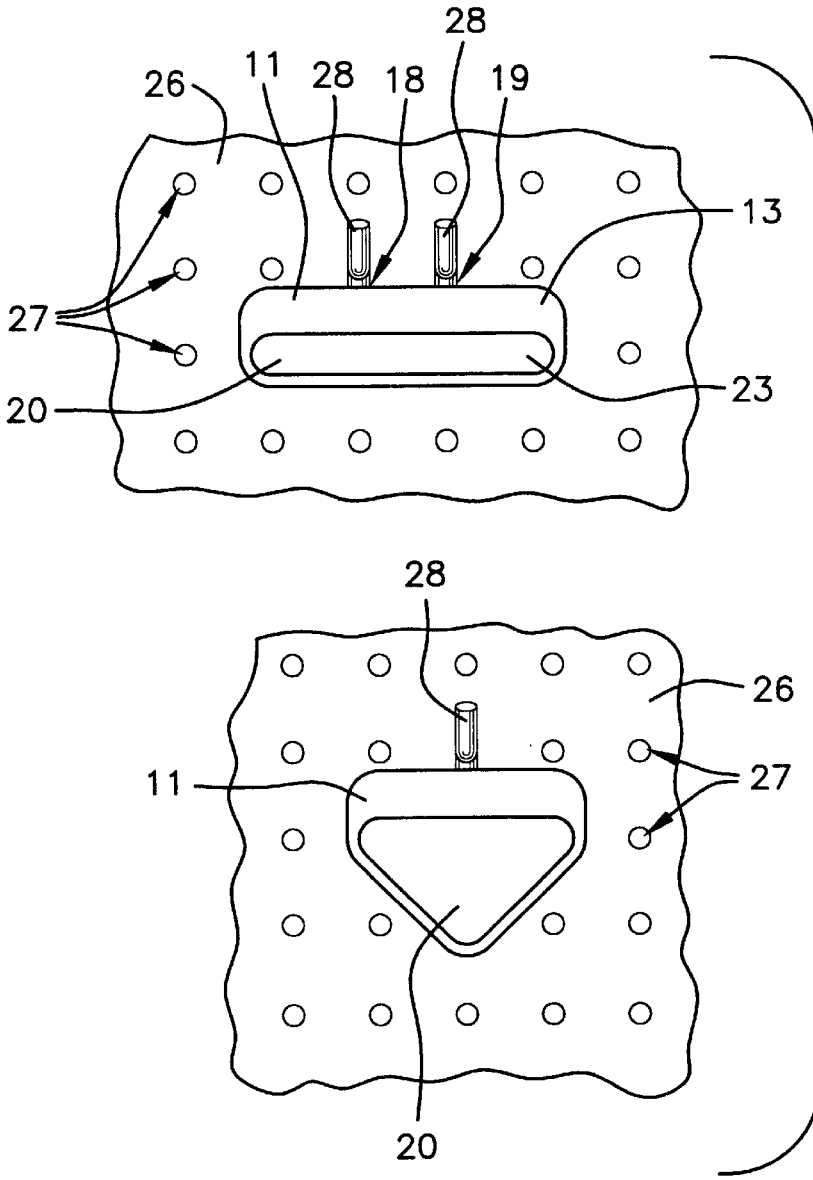
FIG. 4 is front elevational view of the present invention shown in use.

With reference now to the drawings, and in particular to FIGS. 1 through 4 thereof, a new peg retaining device embodying the principles and concepts of the present invention and generally designated by the reference numeral 10 will be described.

As best illustrated in FIGS. 1 through 4, the peg retaining device 10 generally comprises a retainer 11 having a generally planar back side 12 and also having a top 14, a bottom 15, and a front side 13, and being adapted to mount over and cover a portion of at least one peg 28 on a pegboard 26 for securely retaining the at least one peg 28 to the pegboard 26. The retainer 11 includes at least one groove 18,19 disposed in the back side 12 thereof and extending through the top 14 and the bottom 15 thereof. The at least one groove 18,19 is adapted to receive an intermediate portion of the peg 28 with the retainer 11 being generally an elongate block-like member being adapted to engage the at least one peg 28 between itself and the pegboard 26. The retainer 11 includes holes 16,17 disposed therethrough from the front side 13 to the back side 12 and near ends thereof with, the retainer 11 having a length of approximately 2 inches, and width of approximately ¾ inch, and a thickness of approximately ¾ inch.

Fastening members 20,23 are disposed through the retainer 11 and are adapted to securely and removably engage in holes 27 of the pegboard 26. The fastening members 20,23 are removably extended through the holes 16,17 of the retainer 11. Each of the fastening members 20,23 has an elongate portion 21,24 and a head portion 22,25 with the elongate portion 21,24 of each fastening member 20,23 having a tapered end for facilitating entry of the fastening member 20,23 in a hole 27 of the pegboard 26 and with the head portions 22,25 of the fastening members 20,23 being integrally connected to one another. As a first embodiment, the at least one groove 18,19 includes a groove 18 centrally disposed in the back side 12 of the retainer 11. As a second embodiment, the at least one groove 18,19 includes a pair of grooves 18,19 being spaced apart.

In use, the user inserts a peg 28 into one of the holes 27 in the pegboard 26 and places the retainer 11 over the intermediate portion of the peg 28 with the intermediate portion being received in the groove 18,19 of the retainer 11. The user then inserts the fastening members 20,23 through the holes 16,17 of the retainer 11 and into the holes 27 of the pegboard 26 to securely engage and fasten the peg 28 to the pegboard 26.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A peg retaining device comprising:

a retainer for retaining a peg on a pegboard, said retainer comprising a main portion and a pair of insertion portions for removably inserting into holes in the pegboard, said main portion having a front side and a back side, said back side having at least one groove formed therein for mounting over a portion of a peg when the peg is mounted on the pegboard, said inserted portions extending rearwardly from said back side of said main portion, a passage extending through each of said insertion portions and through said main portion between said front side and said back side; and a fastening member having a head portion and a pair of prong portions, each of said prong portions being removably mounted in said passage of said retainer, said prong portions expanding a tip section of said insertion portion of said retainer when said prong portions are positioned in said insertion portions of said retainer for securing said insertion portions in the holes of the pegboard to thereby hold the retainer against the peg and the pegboard.

2. A peg retaining device as described in claim 1, wherein said retainer includes a pair of grooves disposed in said back side thereof.

3. A peg retaining device as described in claim 1, wherein said retainer is generally an elongate block-like member.

4. A peg retaining device as described in claim 1, wherein said tip sections of said insertion portions of said retainer have a tapered end for facilitating entry of said insertion portion in a hole of the pegboard.

5. A peg retaining device as described in claim 1, wherein said at least one groove includes a groove centrally disposed in said back side of said main portion of said retainer.

6. A peg retaining device as described in claim 1, wherein said at least one groove includes a pair of grooves being spaced apart.

7. A peg retaining device as described in claim 1, wherein said prong portions have tapered ends for facilitating insertion of said prong portions in to said passages of said retainer.

8. A peg retaining device as described in claim 1, wherein said insertion portions of said retainer have a plurality of slots formed therein for permitting expansion of said insertion portions when said prong portions are inserted into said passages of said retainer.

9. A peg retaining device comprising:

a retainer for retaining a peg on a pegboard, said retainer comprising a main portion and a pair of insertion portions for removably inserting into holes in the pegboard, said main portion having a front side and a back side, said back side having at least one groove formed therein for mounting over a portion of a peg when the peg is mounted on the pegboard, said retainer including a main portion and a pair of insertion portions, said insertion portions extending rearwardly from said back side of said main portion, a passage extending through each of said insertion portions and through said main portion between said front side and said back side; and a fastening member having a head portion and a pair of prong portions, each of said prong portions being removably mounted in said passage of said retainer, said prong portions expanding a tip section of said insertion portion of said retainer when said prong portions are positioned in said insertion portions of said retainer for securing said insertion portions in the holes of the pegboard to thereby hold the retainer against the peg and the pegboard;

wherein said retainer includes a pair of grooves disposed in said back side thereof;

wherein said retainer is generally an elongate block-like member;

wherein said tip sections of said insertion portions of said retainer have a tapered end for facilitating entry of said insertion portion in a hole of the pegboard;

wherein said at least one groove includes a groove centrally disposed in said back side of said main portion of said retainer;

wherein said at least one groove includes a pair of grooves being spaced apart;

wherein said prong portions have tapered ends for facilitating insertion of said prong portions in to said passages of said retainer; and wherein said insertion portions of said retainer have a plurality of slots formed therein for permitting expansion of said insertion portions when said prong portions are inserted into said passages of said retainer.

* * * * *